US008955448B1

(12) United States Patent
Altman et al.

(10) Patent No.: US 8,955,448 B1
(45) Date of Patent: Feb. 17, 2015

(54) METHOD AND VESSEL FOR SHIPPING HAZARDOUS CHEMICALS

(71) Applicants: Joel G. Altman, Houston, TX (US); Scott A. Davis, Houston, TX (US)

(72) Inventors: Joel G. Altman, Houston, TX (US); Scott A. Davis, Houston, TX (US)

(73) Assignee: Minyan Marine LLC, Houston, TX (US)

( * ) Notice: Subject to any disclaimer, the term of this patent is extended or adjusted under 35 U.S.C. 154(b) by 117 days.

(21) Appl. No.: 13/764,130

(22) Filed: Feb. 11, 2013

Related U.S. Application Data

(60) Provisional application No. 61/607,099, filed on Mar. 6, 2012.

(51) Int. Cl.
*B63B 21/56* (2006.01)
*B63B 3/56* (2006.01)

(52) U.S. Cl.
CPC .. *B63B 3/56* (2013.01); *B63B 21/56* (2013.01)
USPC ..... 114/248; 114/77 R; 114/249

(58) Field of Classification Search
USPC ..... 114/26, 77 R, 248, 249
See application file for complete search history.

(56) References Cited

U.S. PATENT DOCUMENTS

| | | | | |
|---|---|---|---|---|
| 3,557,742 | A * | 1/1971 | Gainsley | 114/248 |
| 5,558,036 | A * | 9/1996 | Hara | 114/249 |
| 6,162,105 | A * | 12/2000 | Breivik | 114/77 R |
| 6,418,869 | B1 * | 7/2002 | Miller | 114/26 |
| 7,424,857 | B2 * | 9/2008 | Pollinger et al. | 114/26 |

OTHER PUBLICATIONS

International Maritime Organization, "Formal Safety Assessment—FSA—Dangerous Goods Transport with Open-Top container vessels", Sep. 10, 2009.

* cited by examiner

*Primary Examiner* — Lars A Olson
(74) *Attorney, Agent, or Firm* — Greenberg Traurig, LLP

(57) ABSTRACT

A method and vessel for shipping hazardous chemicals, includes an articulated tug barge having a plurality of holds substantially filled with containers or tanks of hazardous chemicals, each container, or tank, being associated with an ISO frame, and the holds include a plurality of cofferdam bulkheads.

16 Claims, 5 Drawing Sheets

METHOD AND VESSEL FOR SHIPPING HAZARDOUS CHEMICALS

RELATED APPLICATION

This application is related to, and claims the benefit and priority benefit, of U.S. Patent Application Ser. No. 61/607,099, filed Mar. 6, 2012, entitled "Method and Vessel for Shipping Hazardous Chemicals".

BACKGROUND OF THE INVENTION

1. Field of the Disclosure

This disclosure relates generally to the field of shipment of hazardous chemicals, and in particular a method for shipping hazardous chemicals from one port to another port, and a vessel for shipping hazardous chemicals from one port to another port.

2. Description of the Related Art

Chemicals typically are transported from the manufacturer's plant to its customers in large railroad tank cars, and the chemicals travel over the nation's railroads to the chemical manufacturer's customers who have purchased the chemicals. Such chemicals may include hazardous chemicals, such as toxic gases and flammable and combustible liquids. For example, toxic gases include chlorine and ammonia. Examples of flammable and combustible liquid chemicals could include paints, varnishes and lacquers. If a chemical manufacturer has sold less than a railroad tank car load, or carload, quantity of its chemicals, such less-than-carload quantities are typically shipped via long haul tanker trucks.

There are disadvantages associated with shipment of less than carload quantities of hazardous chemicals by long haul tanker trucks, resulting from the possibility of traffic accidents damaging the tanker truck, and causing the undesired release of the chemicals. Additionally, as tanker trucks are typically driven upon major highways which frequently pass through heavily populated areas, the undesired release of the chemicals could harm many individuals. As to shipment of chemicals by railroad, such railroads also typically pass through heavily populated areas in the United States, and there have been reports of potential terrorist attacks upon railroads in the United States, which could lead to the undesired discharge of the chemicals into such heavily populated areas.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a method of shipping hazardous chemicals from a first port to a second port is disclosed which may comprise: at the first port, loading a first plurality of containers of hazardous chemicals, each of the first plurality of containers being associated with an ISO frame, into a plurality of holds in an ocean-going, articulated tug barge; substantially filling each of the plurality of holds with the first plurality of containers of hazardous chemicals and their associated ISO frames; disposing a tug in the stern of the articulated tug barge, and moving the tug and barge to the second port.

In another illustrative embodiment, a vessel for the shipment of hazardous chemicals from a first port to a second port is disclosed which may comprise: an ocean-going, articulated tug barge having a hull with a bow and a stern; the stern of the hull having a notch for receipt of a tug for moving the barge; the hull of the barge having a plurality of holds, at least some of the holds being separated from adjacent holds by a cofferdam bulkhead; a first plurality of containers containing hazardous chemicals, each of the first plurality of containers being associated with an ISO frame, disposed within the plurality of holds; a plurality of hatch covers associated with at least some of the plurality of holds, with a second plurality of containers containing hazardous chemicals disposed above at least some of the plurality of hatch covers, each of the second plurality of containers being associated with an ISO frame; and each of the plurality of holds are substantially filled with the first plurality of containers of hazardous chemicals and their associated ISO frames.

BRIEF DESCRIPTION OF THE DRAWING

The present method and vessel for shipping hazardous chemicals from a first port to a second port may be understood by reference to the following description taken in conjunction with the accompanying drawing, in which.

Figure 1:
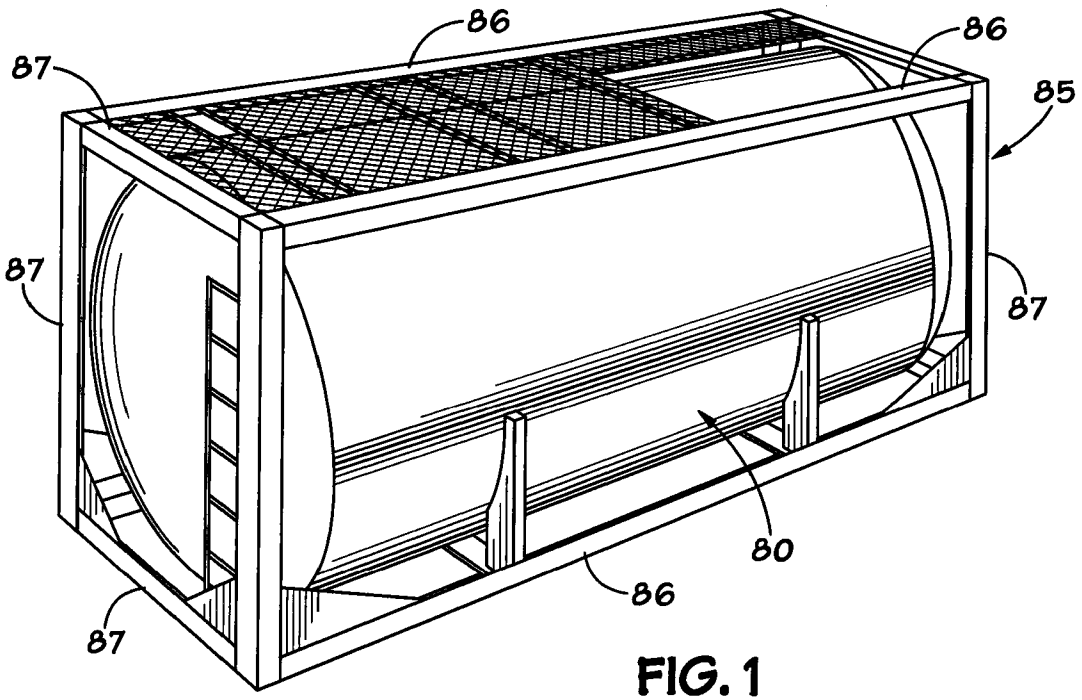
FIG. 1 is a perspective view of a container for hazardous chemicals, associated with an ISO frame.

While certain embodiments of the present method and vessel for shipping hazardous chemicals will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

With reference to FIG. 1, a container 80 for the storage of hazardous chemicals is shown associated with, or disposed within, a standard ISO frame 85. ISO stands for the International Standards Organization. Typically, ISO frame 85 is approximately 20 feet in length and approximately 8 feet high and approximately 8 feet wide, and is formed by a plurality of rail members, such as side rails 86 and end rails 87. Container 80 is received and secured within ISO frame 85 in a conventional manner. Tank 80 is preferably of conventional construction, in accordance with specifications set forth in the International Maritime Dangerous Goods Code ("IMDG Code") of the International Maritime Organization, a United Nations specialized agency responsible for safety and security of shipping and the prevention of marine pollution by ships. Tank 80 is formed of any material suitable for the storage of the hazardous chemicals being transported. Stainless steel is the preferred material from which to make tanks 80; however, suitable plastic materials could also be utilized for tanks 80, provided they have the requisite strength and corrosion resistant characteristics to permit them to contain and store the hazardous chemicals and to be transported by an ocean-going vessel. Container 80 may be provided with conventional valves, piping, and closures (not shown) for the filling and emptying of containers 80. It should be noted that although ISO frame 85 is described as a conventional 20 foot long ISO frame, containers 80 may be utilized which fit within other sizes of ISO frames, such as approximately 10 foot long ISO frames 85. Typically, a 20 foot long ISO frame 85 may have a container, or tank, 80 associated with it that holds approximately 6,600 gallons of liquid hazardous chemicals, although containers, or tanks 80, holding a lesser or greater amount of hazardous chemicals may also be utilized.

With regard to the shipping or transportation of a plurality of containers 80 and their associated ISO frames 85, containers 80 and ISO frames 185 are to be shipped by use of an articulated tug barge ("ATB") 100, as will be hereinafter described, and the articulated tug barge will be moved in U.S. coastal waters subject to the provisions of the Section 27 of the Merchant Marine Act of 1920, generally referred to as the Jones Act, as well as will travel in the open ocean. Examples of routes by which the containers 80 of hazardous chemicals may be shipped between two or more ports include between: Puerto Rico and ports in the continental United States; Hawaii and ports in the continental United States; ports on the Gulf Coast of the United States and ports on the East Coast of the United States; ports of the Gulf Coast and the West Coast of the United States; and ports in California and Alaska, being just a few representative routes. The types of hazardous chemicals and substances which may be shipped within containers 80 will typically include, among others, those designated as Class 2.3, Class 3, Class 6.1, Class 8, and/or Class 9, hazardous chemicals and substances as set forth in the IMDG Code. Class 2.3 hazardous chemicals generally include toxic gases, such as ammonia and chlorine, and Class 3 hazardous chemicals are generally flammable and combustible liquids, as previously described. Class 6.1 generally includes, toxic substances and Class 8 generally includes corrosive substances. Class 9 substances are generally referred to as miscellaneous dangerous substances. The use of the term "hazardous chemicals" is intended to cover both hazardous chemicals and hazardous substances.

Figure 2A:
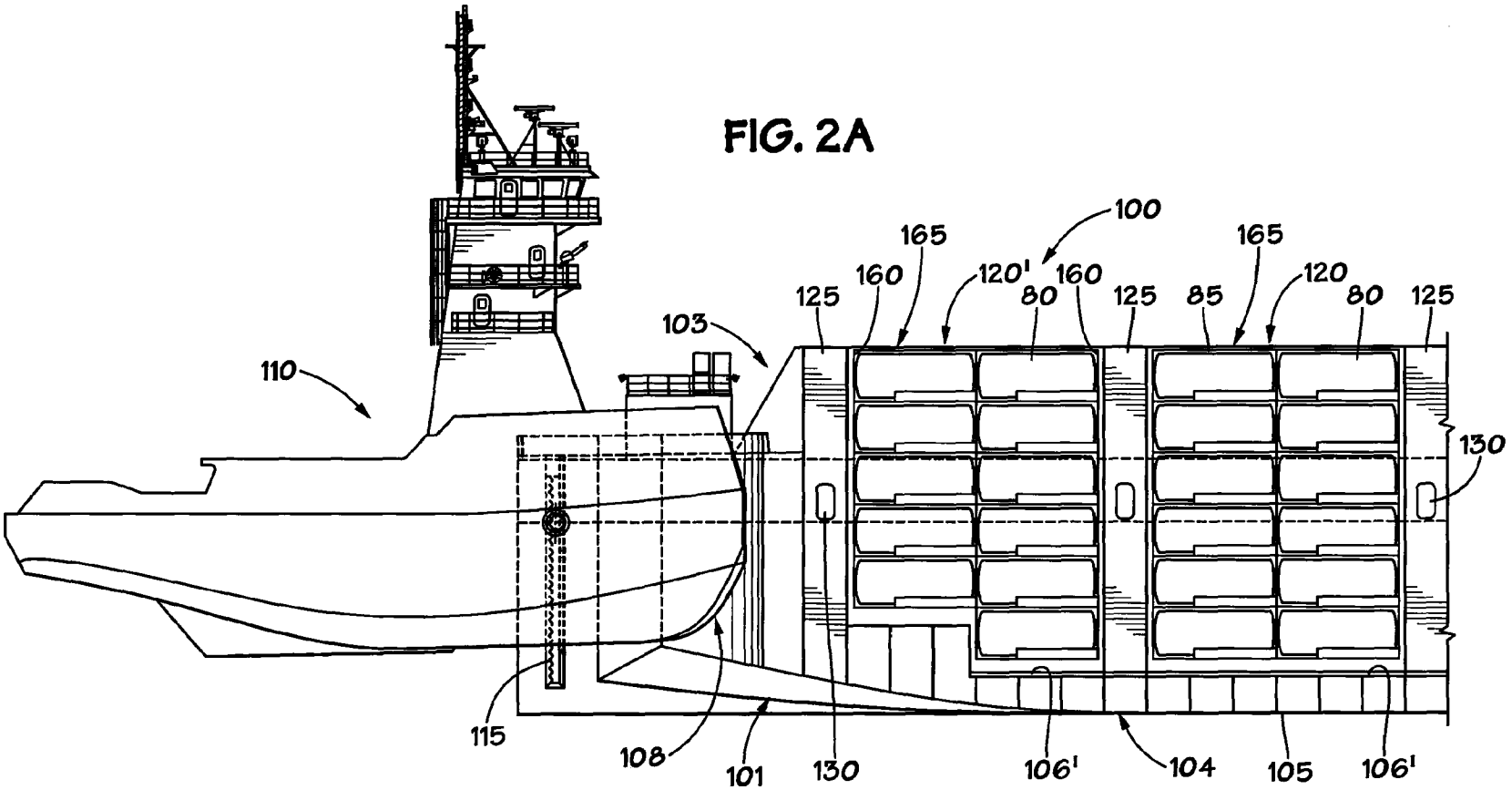
FIG. 2A is a partial cross-sectional side view of a tug received within the stern of the hull of an articulated tug barge.
Figure 2B:
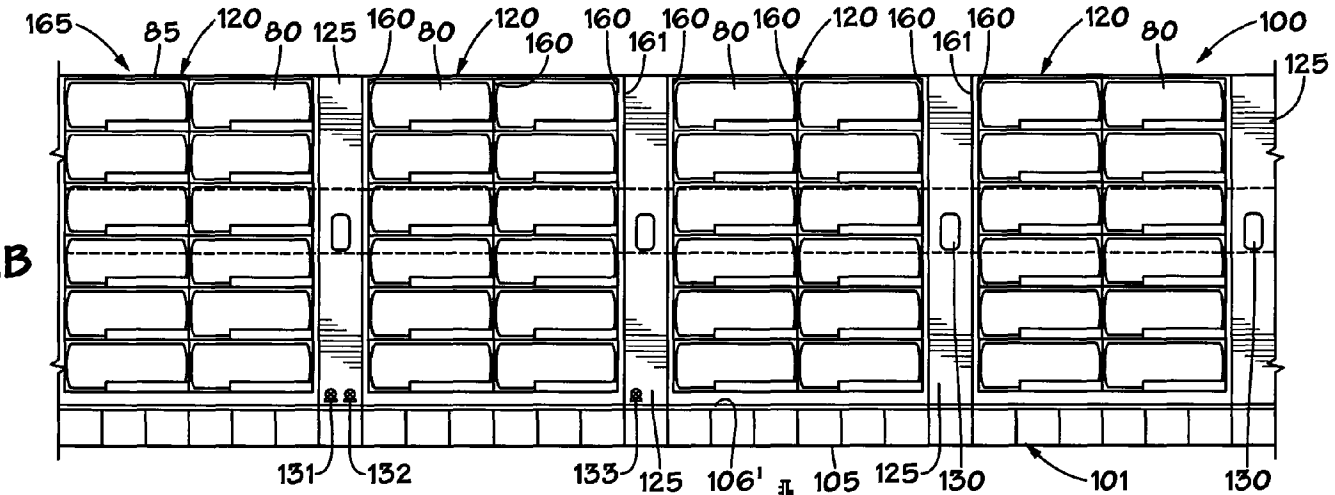
FIG. 2B is a continuation of FIG. 2A, and is a partial cross-sectional side view of the amidships of the articulated tug barge of FIG. 2A.
Figure 2C:
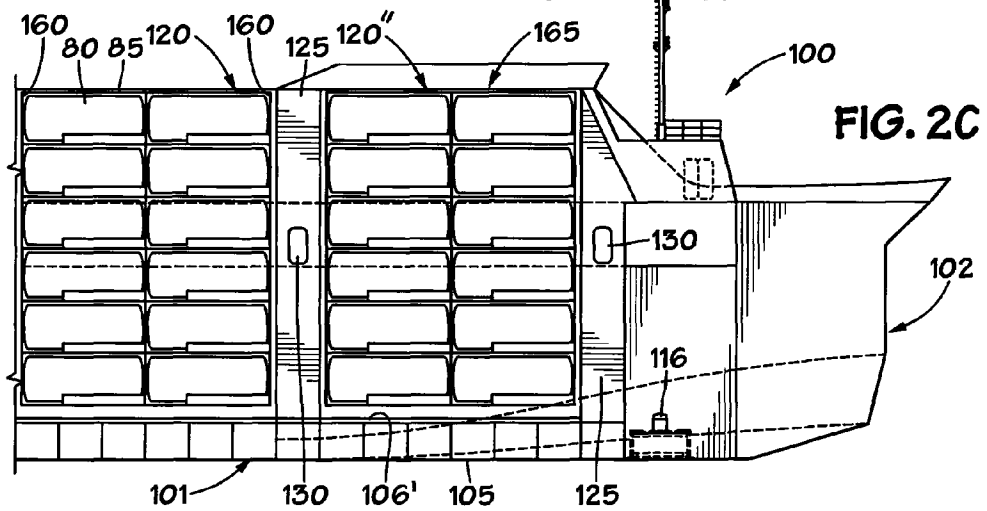
FIG. 2C is a continuation of FIG. 2B, and is a partial cross-sectional side view of the bow of the articulated tug barge of FIGS. 2A and 2B.
Figure 3:
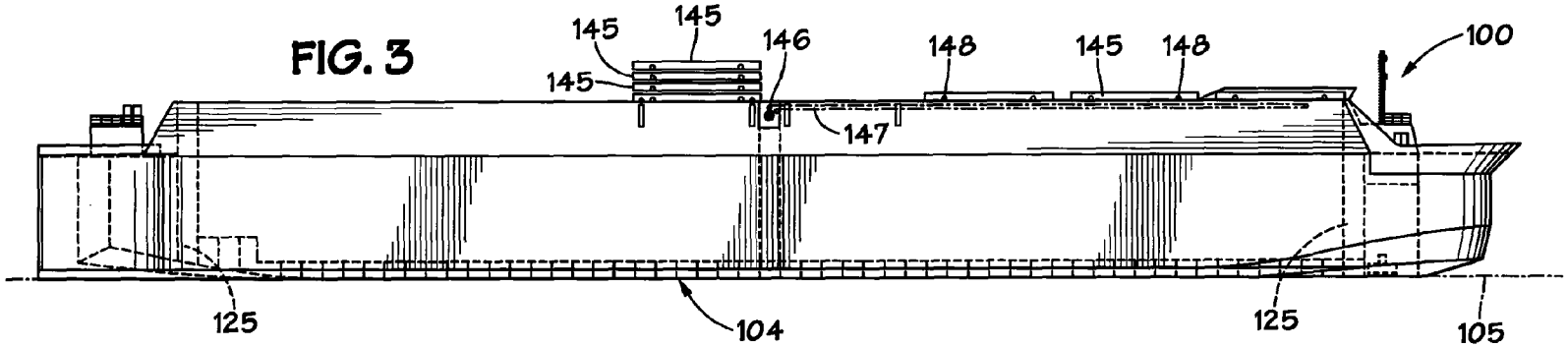
FIG. 3 is a side view of an articulated tug barge, similar to that of FIGS. 2A-2C, illustrating the use of hatch covers.
Figure 4:
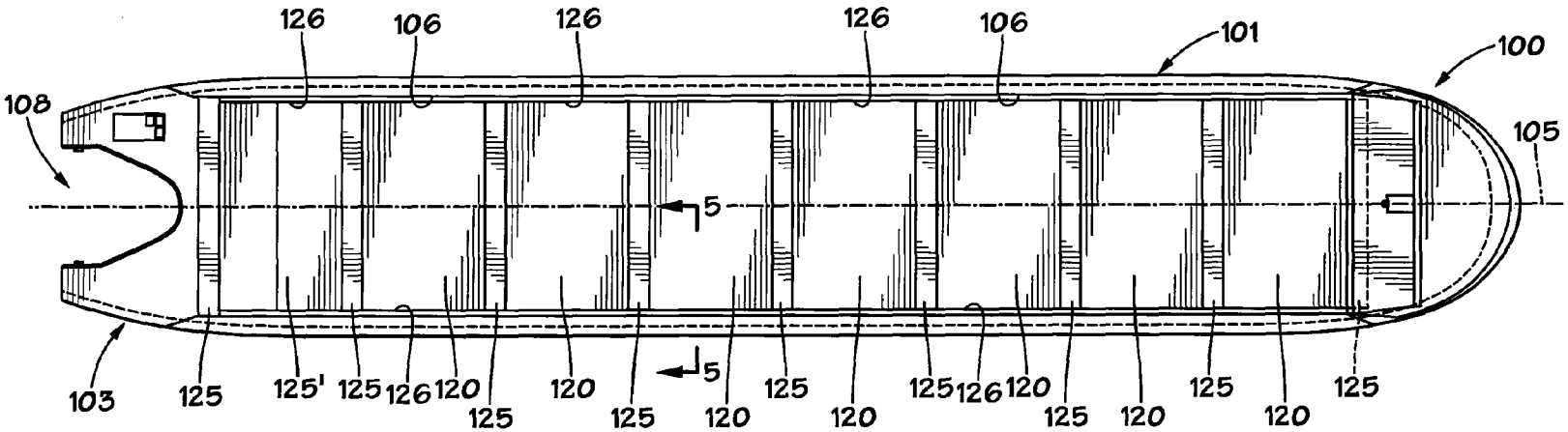
FIG. 4 is a top view of the articulated tug barge of FIG. 3, which is similar to that of the articulated tug barge of FIGS. 2A-2C.
Figure 5:
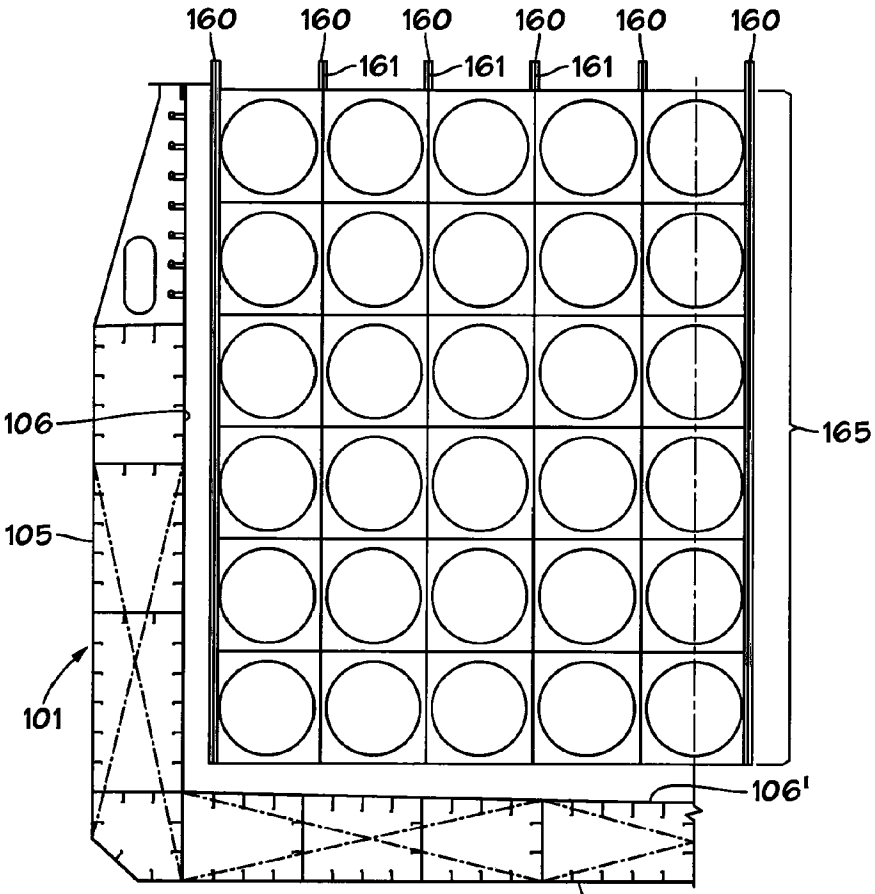
FIG. 5 is a partial cross-sectional view taken along lines 5-5 of FIG. 4, including some of the containers illustrated in FIGS. 2A-2C.

With reference to FIGS. 2A-2C, 3 and 4, the present articulated tug barge 100 will be described. The present ocean-going, articulated tug barge 100 generally includes a hull 101, a bow 102 (FIG. 2C), a stern 103 (FIG. 2A), and a keel 104 (FIG. 2A), which keel lies in a plane which is coplanar with the longitudinal axis 105 (FIG. 4) of hull 101 (FIG. 4). Preferably hull 101 is of a double wall construction, whereby there is an outer hull, or outer wall surface, 105 and an inner hull, or inner wall surface, 106, 106' as seen in FIGS. 2B and 5. If desired, other suitable shapes and designs for the hull 101, including bow 102 and stern 103, may be utilized.

With reference to FIGS. 2A and 4, the stern 103 of hull 101 includes a notch, or opening, 108 for receipt of a tug 110 which provides the motive force to move the articulated tug barge 100 on its course between its ports of call. The tug, or tug boat, 110 may be of any suitable construction, provided it has the necessary power to move the articulated tug barge 100 when it is fully loaded with its cargo of hazardous chemicals, and provided the tug 110 can properly mate with the notch 108 of articulated tug barge 100 and cooperate with coupler 115, which permits compensation for a change in the draft of the articulated tug barge ("ATB") 100 dependent upon whether or not the ATB is fully loaded carrying full containers 80 of hazardous chemicals or is transporting empty containers 80, or a combination of full and empty containers 80. As an example and for illustrative purposes only, tug 110 may be a diesel/electric, multi-generator design of approximately 8,000 to 9,000 horsepower, or may be dual fuel diesel electric motors of approximately 10,000-12,000 horsepower, whereby the tug may provide power to thruster 116 (FIG. 2C) disposed adjacent the bow 102 of ATB 100, as well as provide power for pumps and other equipment, as will be hereinafter described, associated with the ATB 100.

With reference to FIGS. 2A-2C, it is seen that the hull 101 of the ATB 100 is provided with a plurality of holds 120, 120' for storing containers 80 in their associated ISO frames 85. As seen in FIGS. 2A, 2C, and 4, at least some of the holds 120 are separated from adjacent holds 120, 120' by a cofferdam bulkhead 125. Preferably, all of the holds 120, 120' are separated from their adjacent holds 120, 120' by cofferdam bulkheads 125. With respect to the aftmost hold 120', a cofferdam bulkhead 125 is also provided adjacent the stern 103 (FIG. 2A), as is a cofferdam bulkhead 125 provided adjacent the bow 102 for the fore-most hold 120, whereby it is seen that each hold 120', 120 includes two cofferdam bulkheads 125. As seen in FIG. 4, at least some, and preferably all, of the cofferdam bulkheads lie in vertical planes which are disposed substantially perpendicular to the keel 104, or longitudinal axis 105 of hull 100. Alternatively some cofferdam bulkheads defining holds 120, 120' could lie in vertical planes which are disposed substantially parallel to the keel 104, or longitudinal axis 105, of hull 100. Alternatively, a combination of cofferdam bulkheads 125 could lie in vertical planes which are disposed substantially parallel, as well as cofferdam bulkheads 125 disposed substantially perpendicular to the keel 104, or longitudinal axis 105 of hull 100.

As shown in FIG. 4, the cofferdam bulkheads, or transverse cofferdam bulkheads, 125 form two sides of each hold 120', 120, and the other two sides, or wall surfaces, 126 of each of the holds 120 is provided by the inner hull, or inner wall surface, 106 of hull 101. Similarly, the lower wall surface of each hold 120 is provided by the lower inner hull, or lower inner wall surface, 106' of hull 101. All of the cofferdam bulkheads 125 are substantially fluid tight, or preferably fluid tight, as well as substantially fume tight, or preferably fume tight, whereby undesired fluid present in one hold 120 cannot pass through the cofferdam bulkhead 125 into an adjacent hold 120, nor can the fluid enter into the interior of a cofferdam bulkhead 125. Similarly, any fumes in one hold 120 may not pass through a cofferdam bulkhead 125 into an adjacent hold 120, nor can fumes from within one hold 120 enter the interior of an adjacent cofferdam bulkhead 125.

Still with reference to FIGS. 2A-2C, at least some and preferably all, of the cofferdam bulkheads 125 include accessways 130, permitting access to the interior of the cofferdam bulkheads 125. Additionally, as seen in FIGS. 2A-2C, bilge pumps 131 and fire-fighting pumps 132 may be disposed within the interior of one or more, or each, cofferdam bulkhead 125. The bilge pumps 131 being provided for draining water which may collect in the bottom of some of the holds 120, and the fire-fighting pumps 132 are provided to pump water to extinguish any undesired fire occurring in one of the holds 120. If desired, dispersant pumps 133 may also be disposed within the interior of one of more, or each, cofferdam bulkhead 125 to pump a suitable dispersant into a hold 120 to promote dispersion of any materials which are inadvertently released into any of the holds 120. Additionally, the interior of at least some, or preferably all, of the cofferdam bulkheads 125 may be used for running the piping (not shown) for the various pumps 131-133, as well as related electrical wiring (not shown). The bilge pumps 131 may be utilized to either collect water from a hold 120 and pump it overboard, or to collect any water in a hold which has become contaminated and to send such contaminated water to holding tanks (not shown) which may be disposed in the lower portion of the hull between the outer hull 105 and the lower inner hull 106' (FIG. 5). Alternatively if desired, all, or some, of the pumps 131-133 and their related piping and wiring may be disposed adjacent the holds 120 in the space between the outer hull 105 and inner hull 106, 106'.

Figure 6:
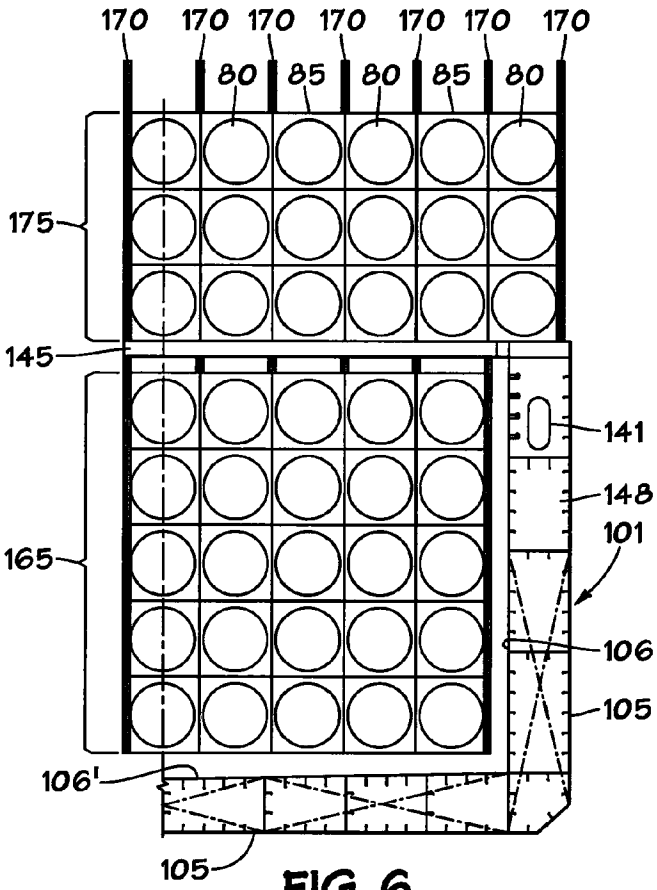
FIG. 6 is a partial cross-sectional view similar to that of FIG. 5, which illustrates containers of hazardous chemicals in ISO frames being stowed above the hatch covers of FIG. 3 of an articulated tug barge.

With reference to FIGS. 5 and 6, the upper portion of hull 101 may be provided with a walkway, or internal walkway, 140 extending from bow 102 to the stern 103 of ATB 100 which provides a protected passageway from the tug 110 to the bow 102 of ATB 100. Internal walkway 140 may also be provided with hazardous vapor detection equipment and explosion-proof lighting and ventilation equipment, if desired. If desired, an additional external walkway 141 (FIG. 6) may also be provided at the top of hull 101.

With reference to FIGS. 3 and 6, ATB 100 is preferably provided with a plurality of hatch covers 145 for at least some, and preferably all, of the plurality of holds 120, 120' and hatch covers 145 are sized to overlap and cover the top open ends of each of the holds 120, 120'. As seen in FIG. 3, the plurality of hatch covers 145 may be stored above the holds 120, 120' and may be stacked upon each other and then moved into position by the use of hydraulic equipment, or hydraulic motors 146 associated with a chain drive 147 and jackup cylinders 148 for moving the hatch covers 145 into position above each of the top open ends of hulls 120. After the hatch covers 145 are associated with at least some, and preferably all of the holds 120, 120', containers 80 with their associated ISO frames, may be disposed above the hatch covers 145 as shown in FIG. 6 and as will be hereinafter described in greater detail.

With reference to FIGS. 2A-2C, at least some of the holds 120, 120', and preferably all of the holds 120, 120', are associated with a plurality of cell guides 160 which cooperate with the ISO frames 85 to hold and secure each ISO frame 85 and its related container 80 within the holds 120, 120'. Cell guides 160 are of conventional construction in compliance with an ISO standard for such cell guides. The vertically disposed cell guides 160 include vertical guide rails, such as 161 in FIG. 2B. Preferably, the cell guides 160 are attached to the cofferdam bulkheads 125 as shown in FIG. 2B with a cell guide 160 provided between each vertical column of adjacent ISO frames, and a cell guide 160 for the outermost column of ISO frames disposed adjacent the inner hull 106 as shown in FIG. 5. A plurality of first cell guides 160 are preferably provided with each of the holds for securing a first plurality of containers 80 containing hazardous chemicals within the plurality of holds 120, 120' as shown in FIGS. 2A-2C and 5. As shown in FIGS. 2A-2C and 5, all of the holds 120, 120' are filled with the first plurality 165 of containers 80 of hazardous chemicals and their associated ISO frames 85, as it is more economical to ship containers 180 if all the holds 120, 120' are completely filled as shown in FIGS. 2A-2C; however, it should be understood that it is only necessary that holds 120, 120' be substantially filled, rather than completely filled, with the first plurality of containers 80 of hazardous chemicals and their associated ISO frames 85. For example, substantial safety and cost savings benefit are still obtained through use of the present ATB 100, if approximately one-half, or approximately 50%, of the plurality of holds 120, 120' are filled with the first plurality 165 of containers 80 and their associated ISO frames 85.

With reference to FIG. 6, a plurality of second cell guides 170 are provided and extend above the plurality of hatch covers 145. The plurality of second cell guides 170 hold and secure a second plurality 175 of containers 80 containing hazardous chemicals disposed above at least some, and preferably all, of the plurality of hatch covers 145. The second plurality 175 of containers 80 similarly are each associated with an ISO frame 85.

Although various types of hazardous chemicals may be shipped by the present ATB 100, it is preferred that substantially all of the first plurality 165 of containers 80, loaded and secured within the plurality of holds 120, 120', 120"contain Class 3, Class 6.1, Class 8, and/or Class 9 hazardous chemicals of the IMDG Code ("Non-Class 2.3 Hazardous Chemicals). The second plurality 175 (FIG. 6) of containers 80 secured above the hatch covers 145 contain Class 2.3 hazardous chemicals of the IMDG Code as Class 2.3 Hazardous Chemicals are required to be only stored and shipped above the hatch covers 145. For example, in the illustrative embodiment of ATB 100 illustrated in FIGS. 2A-2C, each of the holds 120 can accommodate approximately 108 containers 80 filled with Non-Class 2.3 Hazardous Chemicals. Hold 120' may hold approximately 99 containers 80 of Non-Class 2.3 Hazardous Chemicals. Hold 20" may hold approximately 102 containers 80 of Non-Class 2.3 Hazardous Chemicals. If desired, approximately 432 containers 80 of the second plurality 175 of containers 80 containing Class 2.3 hazardous chemicals may be secured and shipped above the 8 hatch covers 145, as shown in FIG. 6. The number of containers 80 of Non-Class 2.3 Hazardous Chemicals that may be secured and shipped within holds 120, 120' and 120" are for illustrative purposes only, as a greater or lesser number of containers may be secured within the holds as desired, as well as may vary due to the size and construction of the ATB 100. Similarly, a greater or lesser number of containers 80 containing Class 2.3 Hazardous Chemicals could be secured above the hatch covers 145, as desired, as well as may vary dependent upon the size and construction of the ATB 100 and the number of hatch covers 145 present. Preferably, not more than a combined total of 1000 containers 80 are secured within the holds 120, 120', 120" and secured above hatch covers 145. The foregoing specific numbers of containers are only examples and are for illustrative purposes only.

With reference to FIGS. 2A-2C, the present method of shipping hazardous chemicals from a first port to a second port will be described. At the first port, for example a port on the Texas Gulf Coast, a first plurality 165 of containers 80 of hazardous chemicals, each of the first plurality 165 of containers 80 being associated with an ISO frame 85, as previously described, are loaded, in a conventional manner by use of appropriate dock cranes, into a plurality of holds 120, 120' in the ATB 100 previously described. As previously shown and described in connection with FIGS. 3 and 6, a plurality of hatch covers 145 are associated over at least some, and preferably all, of the plurality of holds 120, 120', and a second plurality 175 of containers 80 containing hazardous chemicals, each container 80 associated with an ISO frame 85, may be disposed above at least some of the plurality of hatch covers 145. Tug 110 is then disposed within the notch 108 (FIG. 4) in the stern 103 of ATB 100. Thereafter the tug 110 is operated to move the tug and ATB 100, with holds 120, 120' being substantially filled with the first plurality 165 of containers 80 of hazardous chemicals, to a second port, for example the port of New York City. The present method may further include transporting to at least one first customer's premises, such as a chemical manufacturing plant, at least one empty container 80 associated with an ISO frame 85, whereby the first customer, or chemical manufacturer, may substantially fill the container, or containers, 80 with a hazardous chemical. Thereafter, the at least one container, or containers, 80 substantially filled with a hazardous chemical may be transported to the first port for subsequent loading into the ATB 100 as previously described. The empty container, or containers, 80 may be transported to the first customer's premises, as by conventional delivery upon a suitable truck trailer, or by short rail drayage. Similarly, the container, or containers, 80, which have been filled with the hazardous chemical, may be transported to the first port by a conventional truck and flat-bed trailer combination, or by short rail drayage. When ATB 100 arrives at the second port, the first and second plurality 165, 175 of containers 80 may be unloaded from the plurality holds 120, 120' and from above the hatch covers 145 and may then be transported to at least one second customer's premises, or to multiple second customers, as by a conventional truck and flat-bed trailer, or by short rail drayage, used to haul ISO frame cargoes.

Specific embodiments of the present method and vessel for shipping hazardous chemicals have been described and illustrated. It will be understood to those skilled in the art that changes and modifications may be made without departing from the spirit and scope of the inventions defined by the appended claims.

We claim:

1. A vessel for the shipment of hazardous chemicals from a first port to a second port, comprising:

an ocean-going, articulated tug barge having a hull with a bow, a stern, and a keel;

the stern of the hull having a notch for receipt of a tug for moving the barge;

the hull of the barge having a plurality of holds, at least some of the holds being separated from adjacent holds by a cofferdam bulkhead;

a first plurality of containers containing hazardous chemicals, each of the first plurality of containers being associated with an ISO frame, disposed within the plurality of holds, wherein a plurality of first cell guides are associated with each of the holds and secure each ISO frame and its associated container within one of the plurality of holds;

a plurality of hatch covers associated with at least some of the plurality of holds, with a second plurality of containers containing hazardous chemicals disposed above at least some of the plurality of hatch covers, each of the second plurality of containers being associated with an ISO frame; and each of the plurality of holds substantially filled with the first plurality of containers of hazardous chemicals and their associated ISO frames.

2. The vessel of claim 1, wherein each hold in the hull includes two cofferdam bulkheads and at least some of the cofferdam bulkheads lie in planes which are disposed substantially perpendicular to the keel.

3. The vessel of claim 1, wherein the cofferdam bulkheads are substantially fluid tight and substantially fume tight.

4. The vessel of claim 3, wherein at least some of the cofferdam bulkheads provide access to at least some of the holds and have bilge pumps for draining water from at least some of the holds, and fire-fighting pumps for pumping water to extinguish any undesired fire in at least some of the holds.

5. The vessel of claim 1, wherein each hold in the hull includes two cofferdam bulkheads, and the plurality of first cell guides are attached to the cofferdam bulkheads.

6. The vessel of claim 1, including a plurality of second cell guides extending above the plurality of hatch covers and securing the second plurality of containers of hazardous chemicals above at least some of the hatch covers.

7. The vessel of claim 1, including a tug disposed within the notch for propelling the barge from the first port to the second port.

8. The vessel of claim 1, wherein substantially all of the first plurality of containers contain Class 3 hazardous chemicals of the International Maritime Dangerous Goods Code.

9. The vessel of claim 1, wherein substantially all of the second plurality of containers contain Class 2.3 hazardous chemicals of the International Maritime Dangerous Goods Code.

10. A method of shipping hazardous chemicals from a first port to a second port, comprising:

at the first port, loading a first plurality of containers of hazardous chemicals, each of the first plurality of containers being associated with an ISO frame, into a plurality of holds in an ocean-going, articulated tug barge, having a hull with a bow, a stern, and a keel, with a notch in the stern of the hull, and substantially filling each of the plurality of holds with the first plurality of containers of hazardous chemicals and their associated ISO frames;

utilizing a plurality of first cell guides associated with each of the holds to secure each ISO frame and its associated container of the first plurality of containers within the plurality of holds;

associating a plurality of hatch covers over at least some of the plurality of holds;

disposing a second plurality of containers containing hazardous chemicals, each container associated with an ISO frame, above at least some of the plurality of hatch covers;

disposing a tug within the notch in the stern of the barge; and moving the tug and barge to the second port.

11. The method of shipping of claim 10, including utilizing a barge having at least some of the plurality of holds separated from adjacent holds by a cofferdam bulkhead.

12. The method of shipping of claim 10, including utilizing a plurality of second cell guides extending above the plurality of hatch covers to secure each ISO frame and its associated container of the second plurality of containers above at least some of the hatch covers.

13. The method of shipping of claim 10, wherein substantially all of the first plurality of containers contain Class 3 hazardous chemicals of the International Maritime Dangerous Goods Code.

14. The method of shipping of claim 10, wherein substantially all of the first plurality of containers contain Class 2.3 hazardous chemicals of the International Maritime Dangerous Goods Code.

15. The method of shipping of claim 10, including:

transporting to at least one first customer's premises at least one empty container associated with an ISO frame, whereby the at least one first customer may substantially fill the at least one empty container with a hazardous chemical; and transporting the at least one container, substantially filled with a hazardous chemical, to the first port.

16. The method of shipping of claim 10, including:

at the second port unloading the first plurality of containers from the plurality of holds; and transporting to at least one second customer's premises at least one of the containers of the first plurality of containers.

* * * * *